United States Patent [19]

Bostian, Jr. et al.

[11] Patent Number: 4,501,631

[45] **Date of Patent: * Feb. 26, 1985**

[54] METHOD FOR PRODUCING UNWOVEN NOVEL ORIENTED PRE-STRESSED WEB

[75] Inventors: Clarence L. Bostian, Jr., Salisbury, N.C.; Jerome D. Gelula, 535 E. 86 St., New York, N.Y. 10028

[73] Assignee: Jerome D. Gelula, New York, N.Y.

[ * ] Notice: The portion of the term of this patent subsequent to Sep. 27, 2000 has been disclaimed.

[21] Appl. No.: 531,874

[22] Filed: Sep. 13, 1983

Related U.S. Application Data

[63] Continuation of Ser. No. 317,042, Nov. 2, 1981, Pat. No. 4,406,724.

[51] Int. Cl.[3] ..... B32B 5/08

[52] U.S. Cl. ..... 156/161; 156/166; 156/229; 156/291; 156/296; 428/198

[58] Field of Search ..... 156/181, 161, 160, 166, 156/180, 229, 296, 291; 428/198, 288, 296, 360, 359, 361, 375

[56] References Cited

U.S. PATENT DOCUMENTS

| | | | |
|---|---|---|---|
| 2,705,687 | 4/1975 | Pettersen et al. | 428/198 |
| 3,641,230 | 2/1972 | Jenks | 264/152 |
| 4,189,512 | 2/1980 | Ellis et al. | 428/198 |

*Primary Examiner*—Michael Ball

*Attorney, Agent, or Firm*—Paul J. Sutton

[57] ABSTRACT

The teachings of the present invention, described in part by reference to a specific embodiment in the following specification, illustrate a novel family of pre-stressed and oriented unwoven fiber webs and products constituting these webs, which are produced according to novel methods practiced by utilizing novel apparatus and equipment. More simply stated, patent protection is sought for the product, methods of making the product, and the equipment used in the methods.

1 Claim, 6 Drawing Figures

METHOD FOR PRODUCING UNWOVEN NOVEL ORIENTED PRE-STRESSED WEB

This is a continuation of application Ser. No. 317,042 filed Nov. 2, 1981 now U.S. Pat. No. 4,406,724.

The present invention relates generally to the field of fiber-type composites, and more specifically to a novel prestressed oriented multi-fiber unwoven web structure, methods and apparatus for producing same, and articles comprising and derived from same.

INTRODUCTION

For years industries and their well-funded technical staffs have been aggressively searching for and attempting to develop a relatively cost-effective yarn, woven, and fiber-based materials with various ratios of binding component-to-fiber of little or no more than fifty percent (50%), and preferably even less than half. Coincidentally, this continuing search for such esoteric materials has taken on increasing importance in the case of new generation synthetics as reliable supplies of oil products become increasingly critical.

The benefits of the system herein described reside in the relatively novel and straightforward approach achieved by this system in solving and overcoming major existing obstacles and problems suffered in the prior art. Those who have overlooked the approach described in detail below and will later attempt to duplicate aspects of our system will be among the first to cry "obvious," having the benefit of both hindsight and the fruits of the labors behind this system. Should an anticipated patent eventuate from this application, and should the importance of the subject system result in patent litigation, the triers of fact (jurors or judges) are respectfully requested to fully examine the directions of the efforts of others in their attempts to achieve what have been lesser results than those realizable utilizing this development.

The prior art is not barren when it comes to fibrous structural materials, generally. Perhaps significant contributions to and teachings of fibrous webs and the methods and apparatus for producing same were made by and in the name of Goldman including, without limitation, patents and prior art based directly and indirectly upon, cited in and citing the following publications: U.S. Pat. Nos. 2,710,992; 2,566,922; 2,565,647; 1,434,917; 2,507,548; 2,863,715; 1,616,062; 2,879,549; 3,482,567, 3,654,060.

It is somewhat ironic that the focus by some in this area has been placed more upon the "plastic" or binder than upon the structural potential of the fibers themselves assuming in primary design responsibility for resisting applied loads and stresses. For example, cotton—a neglected but yet non-essential example of a fiber—when chosen as the fiber to be used in this system, will yield a structural article of remarkable strength, while at the same time exhibiting extremely favorable cost- and strength-to-weight characteristics.

As another example, KEVLAR, a high modular/-high strength, state of the art fiber, developed by Dupont, when chosen as the fiber to be used in this system, will yield distinct and revolutionary strengths where the application warrants its use.

This system, by employing pre-stressing in the finished matrix, enables the user to spontaneously take advantage of the tensile load-resistance properties of most individual fibers upon application of loads, without first having to endure the otherwise necessary delay inherent in conventional fibrous structures whose component fibers require relatively substantial initial elongations and stressing prior to exhibiting these resistance properties. The result, utilizing prestressing, is a system which permits use of lesser amounts of both plastic and fiber, while realizing greater structural integrity and true use of the properties of some new generation fibers.

It cannot be overemphasized here that while a representative example of this invention will be described in which cotton is illustrated as a base fiber, this system contemplates the use of any number of available higher modular staple fibers, as well as possible combinations and hybrids thereof.

SOME OBJECTS OF THE INVENTION

A product of this system is a "family" of unique webs and sheet materials that possess great value when used in a number of commercial applications and environments, including structural materials. A basic product of this system, in its elemental form, includes a coherent web of cobonded oriented, pre-stressed and unwoven fibers which may be used as a component of a ply sheet in the formation of composite sheet matrix (e.g. comprising a plurality of thicknessess or layers of the basic, eventually oriented fibers in preselected directions web materials.

A primary feature of one type of product created by this system resides in the disposition and straightness of the unwoven staple fibers in the basic ("building block") web, whereby relatively high strength-to-weight ratios of fiber-to-web gauge are maintained. The web itself has relatively high resistance to elongation in the directions of longitudinal disposition of the oriented staple fibers and composite fibrous sheet matrixes are contemplated having unusual strength in the oriented direction.

A benefit of this system also resides in the fact that the oriented staple fibers in the basic unwoven fibrous web are directed in a preselected direction so as to enjoy the ultimate practical design strength of the individual component fibers. An example of one approach is to utilize a multiplicity of unwoven fibers which are first straightened such that they are oriented in a state wherein (at their maximum lengths) they are tensioned, discretely bound and cured in a manner described in detail below, prestressed, and stabilized so as to capture in the finished matrix the prestressed condition. This finished matrix, for the most part, comprises a sheet or web that is unusually uniform in fiber density and gauge, even in large webs whose applications require relatively large lateral dimensions.

It is important here to emphasize that by the term "prestressed", this system is not merely referring to a tensioning of the oriented selected unwoven fibers. Mere tensioning—even beyond the point of uncrimping and creating slight elongations—will not result in a fiber free of substantial further elongation when further stressed in the design condition or identified end use. It is this further elongation that is sought to be substantially eliminated in our matrix, such that without prestressed and captured conditions, relatively instantaneous responses to applied stresses (or forces) will be enjoyed via the inability of the individual prestressed fibers to yet further elongate any appreciable amount.

This system is able to produce such a matrix by using a novel method and apparatus which assure uniformity of the oriented and prestressed web. While the fibers that are worked in this system may temporarily exist in the form of slivers while being processed, they are caused to be directed very evenly by successive lapping and drafting operations which result in a uniform, oriented web of substantially straight, tensioned fibers preparatory to this prestressing stage. A possible tendency to distort while in this stage is eliminated via a spreading area chosen to compensate for this potential at higher machine speeds. As a result, a product is created possessing increased strength characteristics that will be reliably exhibited uniformly over the product's useful design areas.

Additionally, it should also be emphasized here that the thrust of the contributions of the present inventions and system is not merely in the direction of plastic contemporary-type material reinforced through the use of non-oriented fibers and the use of woven and other such fiber-converted material structures (wovens, woven materials) as in the case of fiberglass roving and matting, to illustrate. But rather, it is an object of this invention to provide a range of both rigid and flexible web-like materials and sheets of oriented and stressed fibrous materials comprising staple fibers which are suitable for use as necessary components of "building blocks" in the form of structural members—whether they be used to replace what is commonly referred to as cross-sectional shapes yielding the needed moments of inertia and other design/load engineering properties, or of themselves a high-performance fibrous material having special and usable properties.

Another object of the present invention is to provide an oriented staple fiber unwoven web composite whose unit binder content is equal to or less than the unit fiber content.

A further object of our invention (sometimes used synonomously with "system") is to provide a web of material made substantially as described below, from which other original and reinforcing structures may be constructed.

Still another object is to provide a material of relatively high tensile strength characteristics while simultaneously exhibiting relatively low weight factors.

Yet a further object of our invention is to provide for a "universal" type of oriented and prestressed web produced via a novel method with novel apparatus, suitable for a variety of uses, a number of end-uses of which are improvements as related to the present state of the art, in contrast to conventionally designed and accepted purposes, such as industrial flooring and other such utilization. It will be shown that by orienting bonded webs with their component fibers parallel to one another, and thereafter cutting the resultant block at an angle substantially perpendicular with respect to the fiber direction, an extremely strong, reinforced product can be produced by utilizing the exposed fibrous ends and the cobonding material as a combined working surface.

Still a further object is to provide replacement structural materials and articles for those currently being constructed of metallic or even wooden products.

Another object of this invention is to provide a material of staple, unwoven oriented fiber bonded in what will herein be referred to as in a "pre-stressed" state.

A further object of the present invention is to provide a novel material capable of use in marine environments such as, but not limited to, boat hulls and other structures, requiring stable, corrosion resistant, high-impact performance wherein the finished laminated composite leeches a compound capable of retarding marine growth.

Yet a further object is to provide means of orienting, straightening, discretely binding, pre-stressing over and beyond merely creating fiber tension, and finally stabilizing the mass.

A further object of the present invention is to provide an article, as above, wherein full advantage is taken of the tensile strength of individual fibers through elimination of their individual and respective elongation characteristic under certain design loads, by introducing and capturing in the finished web a pre-stress condition.

Still a further object of our invention is to transform in a simple and novel method, using novel combinations of apparatus, certain raw material fibers into finished predetermined oriented pre-stressed fiber composite articles, all in a relatively cost-effective process and without the need for what has heretofore involved repeated handling and making of materials before producing a less effective product.

Yet a further object of the present invention is to provide web and articles formed therefrom, as above, which incorporate fibers such as (but not limited to) Dupont's KEVLAR, so as to provide qualities of high strength, relatively low density, low conductivity, flame resistance, high resistance to creep, rupture and fracture and embodying superior fatigue resistance.

PRIOR EFFECTS OF OTHERS

In the spirit of making as full a disclosure as herein relevant, the following companies and entities appear to be involved at least in part in the research, production or technological survey of composite structures: Union Carbide Corporation, Pittsburgh Plate Glass Company, Owens-Corning Fiberglass Corporation, Exxon Corporation, Leeds University of Great Britain, Johns-Manville Corporation, HITCO, Inc., General Dynamics Corporation, General Electric Corporation, Carborundum Company, Celanese Corporation, and United Technologies Corporation. However, we have no knowledge or even a suspicion that any of the above-named has either made or even suggested efforts involving the present invention.

The foregoing list of objects of this invention represent but a partial listing and effort to briefly present what will be more helpful after a reading of this entire specification. No effort has been made to present a complete listing of the objects of our invention, nor should the specific examples herein presented be construed as either all-inclusive or limiting the true and proper scope of the invention. Other objects will make themselves apparent.

DESCRIPTION OF THE DRAWINGS

The invention and objects thereof will be better understood and exemplified from the following description of the accompanying drawings and the embodiments illustrated therein, and wherein similar reference characters denote similar elements throughout the several views, and wherein.

GENERAL TECHNICAL DESCRIPTION

With a variety of fibers from which to choose in practicing the invention, a specific illustration utilizing cotton fibers will now be described with reference to the accompanying drawings. Obviously, should a party wishing to practice this invention utilize synthetic fibers, a number of steps and apparatus disclosed will be unnecessary and may be eliminated, while a number of additional steps are contemplated. It is important here to emphasize—even at the risk of repetition—that the scope of our invention contemplates not only product (and articles), but also methods of making same and apparatus of varying types utilized in these methods.

At this point in this specification, the author will depart from the often-used technique of first detailing the structural elements and makeup of apparatus before summarizing the overall process, using this equipment. Instead, the reader will now be guided through a process (the reader is urged to refer to FIG. 1) commencing with a most basic step of handling cotton bales to one of a succession of stations where web material is either taken off or diverted to successive applications.

I. Cotton Bale Conveying

The system comprising the present invention may, but does not require, commencing with moving bales of highly compressed cotton fibers initially wrapped for containment to a conveyor. The cotton bales normally contain quantitiesmaters of foreign organic materials.

II. Opening

At a bale opening station, the bale is opened and conditioned in a manner that will allow the fibers to bloom, thereby permitting the return of desirable relative humidity in the range of approximately fifty five percent (55%) or better on the fiber surfaces. By the term "opening" we mean a reduction in the compression state of the fiber mass, thereby permitting further opening and also (and perhaps more importantly) allowing free fibers to be made more compatible with the apparatus that these fibers will next encounter. This preliminary opening of the fiber mass prior to working by machinery aids the removal of foreign matter.

III. Chute Feed Unit

Figure 1:
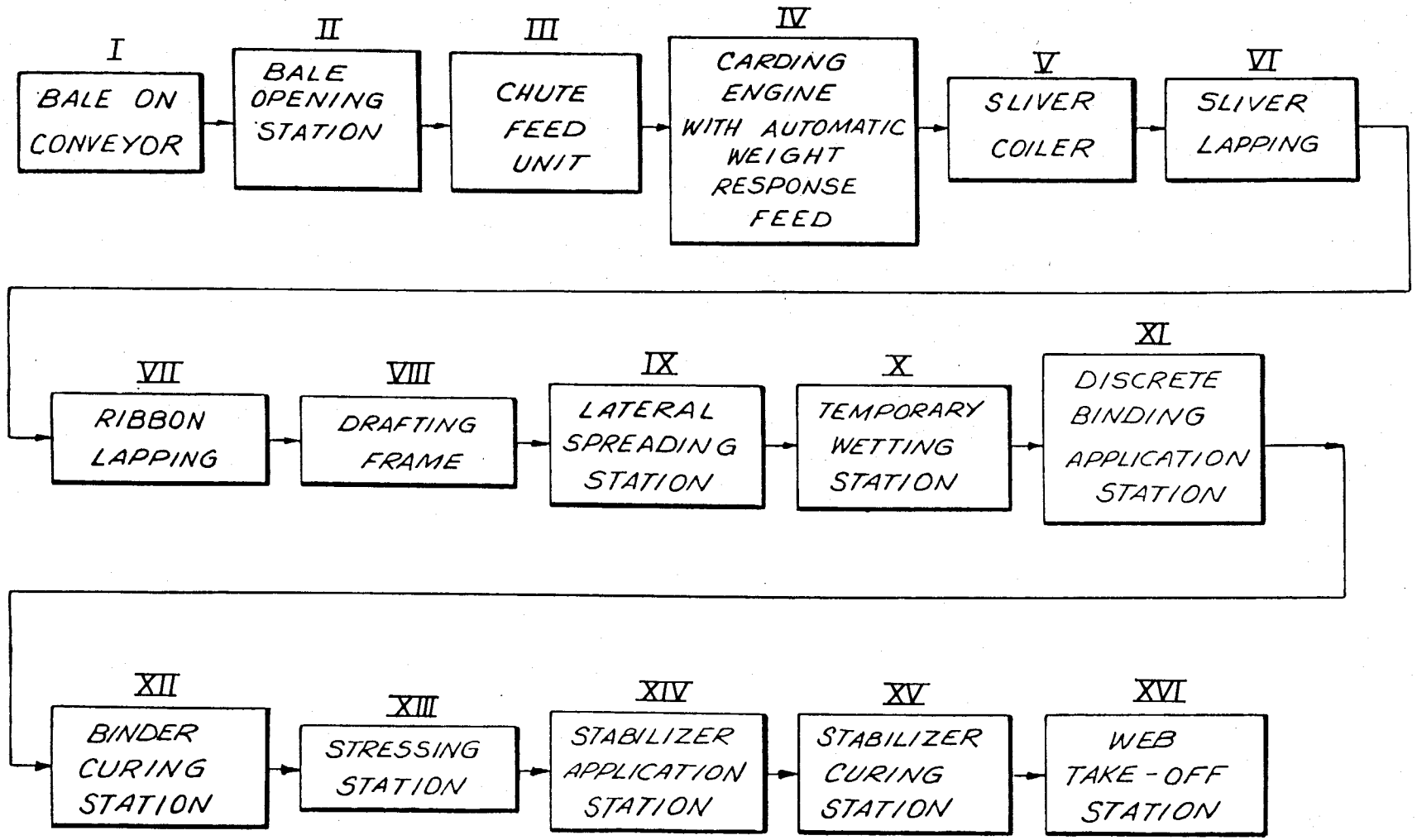
FIG. 1 is a sequential block diagram illustrating both stations (locations) as well as process steps according to the present invention.

The third block of FIG. 1 illustrates the next sequential step of conveying of the opened and cleaned fiber to the fourth station, by means of a chute feed unit. The chute feed unit includes an opening device which both beats and fluffs the fibers even further and thereafter conducts or feeds the resulting mass through a pneumatic duct to each of one or more carding engines (also referred to as "cards") in the production line. Means are provided at or proximate the terminal point of the pneumatic duct for regulating the evenness of the fiber mass, such that a relatively even amount of uniform fiber mass is fed to the carding engine(s). This somewhat minimizes variations of the nominal fiber length being delivered from the carding engine(s).

Parenthetically, it is worth mentioning here that the chute feed unit used according to the present invention is meant to replace what some refer to as a conventional "picker", which could best be described as a machine whose action beats the cotton, thereby allowing dirt and foreign particulate to fall out, and thereafter both fluffing and rolling the cotton mass or "picker lap" of loosely packed fiber normally weighing 14 to 16 ounces per linear yard.

The chute feed unit operates by means of compressed air, rather than by means of gravity, as the term suggests, and a cooperation with a hopper having weight-sensitive controls that, in turn, feeds fiber to a feed roll of the carding engine, which rotates at speeds which feed the card at a constant rate.

IV. Carding Engine

The next and fourth block in FIG. 1 represents the carding engine having the automatic weight responsive feed described in part above. So that the reader and author are using the same language in communicating the teachings of the present invention, "carding" or the "card" serves two basic functions (among others). The carding engine both acts upon and works the fibers so as to orient them in substantially parallel directions and, in the case of natural fibers, also removes a reasonable amount of otherwise entrained foreign matter still trapped in the mass.

A "combing" type of action is achieved by a cooperating series of helically angled teeth (preferrably metallic) supported by and radially extending from cylinders of differing diameters, and being driven at varying relative speeds.

The carding engine provides a dwell time by operating at preselected speeds which allow proper and predetermine combing and orienting characteristics. A minimum rate of two hundred (200) pounds of fiber per hour in the case of the cotton carding engine of the present invention is contemplated, as is currently obtained in conventional equipment, with considerably higher speeds available using synthetic fibers.

V. Silver Coiler

The next station, represented by the fifth block of the diagram of FIG. 1, is one or more of a series of sliver coiler(s). A primary function of the sliver coiler is to coil a slightly twisted rope-like mass at quasi-oriented fiber coming off the carding engine into cylindrical containers or cans, in which a helically wound deposition of sliver is accumulated for later working. This invention contemplates the sliver coiler being either a separate and discreet apparatus or apparatus that may comprise part of the carding engine itself.

At this point in this specification it is important to describe "sliver" as a rope-like form of fiber mass of substantially parallel fibers which emerge from a cylindrical "doffer" with a very slight twist necessary to impart inter-fiber friction to give it sufficient strength for further production handling.

Sliver or receiving cans may be of a single or varying sizes and diameters, and are each removed and stored or moved to the next station when filled with the sliver product being delivered from the card.

VI. Sliver Lapping

The next step, represented by the sixth block of the diagram of FIG. 1, is a step of sliver lapping, or placing of a number of sliver forms in parallel lap form. A number of the sliver-accumulating cans referred to above are positioned in a manner shown in FIG. 5 so as to permit withdrawal of sliver from each, relatively slowly, and in substantially parallel form with respect to one another. A controlled stretching of the parallel slivers within the sliver lapping operation of the present invention begins what will be a successive series of unit weight reducing steps. This stretching or drafting is accomplished by gentle but firm controlled pulling of the parallel slivers in such a way as to encourage individual fibers to begin straightening within each sliver, with the result that these fibers begin to orient themselves (albeit crudely at this point) in substantially parallel configuration. A mixing of the slivers and this drafting of the slivers reduces short-term variations in the product and also allows further amounts of foreign matter to fall from the processed mass.

Before proceeding further to the step of ribbon lapping according to the present invention, the product exiting the sliver lapping station can best be described as a lap of contiguous sliver lengths which, according to the preferred equipment utilized, may contain any predetermined number of slivers. It is also worth emphasizing here that this invention contemplates a novel series of method steps and apparatus that may utilize coiled sliver accumulated in cans at a separate and remote location, using either the steps described above, or other conventional means which do not contain features of our invention. This permits users to have the option of either investing in the coiling equipment of economizing on space and energy.

VII. Ribbon Lapping

The next step of ribbon lapping further serves to draft and parallelize the accumulated sliver mass. A number of sliver laps are overlayed upon one another, so as to wind up with a product that exits this station in the form of a ribbon-in-sliver-form, and it may have the same unit weight, depending upon the amount of drafting involved. The ribbon lapping step represents a further drafting and parallelizing of fibers, while also very significantly improving uniformity of product as a result of the addition of more and more mixed slivers.

VIII. Drafting Frame

The ribbon lap delivered from the ribbon lapping station is fed to a drafting frame station, represented by the next successive block in the diagram of FIG. 1, where more tightly controlled and further drafting of the product is accomplished. It is in this station that the product mass is reduced to a relatively light-weight web with substantially higher degrees of fiber parallelization.

A ribbon lap roll feeds material to drafting rolls or rollers that, sequentially and in a predetermined controlled manner, rotate such that their respective surface speeds vary, increasing sequentially so as to cause a drafting of the fibers held in the "nip" between contiguous and cooperating rolls. For example, the last of the pairs of rollers in the sequence may rotate such that their surface speeds are approximately twice that of the first pair of rollers encountered by the incoming lap entering this station. Thus, one ounce per linear yard of web product entering may be reduced fifty percent (50%) in this station such that the exiting web will weigh but one-half ($\frac{1}{2}$) ounce per linear yard.

In a preferred embodiment of this invention, 4 or 5 pairs of drafting or nip rolls which act upon the fibers have progressively faster surface speeds such that the drafting takes place in a controlled and gradual manner. This invention further contemplates the ability of the user to be able to vary and adjust in a variety of ways the drafting results achieved with the rollers of the drafting frame. This may be done by selectively altering the power transmission means, such as positive gear drives that control each pair of rollers. Also, the surface speeds being referred to here may be varied by changing geartooth ratios in order to assure a desirable delivery.

IX. Lateral Spreading Station

At this point in the process we come to a lateral spreading station, represented by the ninth block in the diagram of FIG. 1, wherein the "delivery" (as this term will be used to describe the product delivered from the drafting frame) is spread laterally to yield the width of product desired, while simultaneously reducing the unit weight of product per linear yard. By thinning out the web to yield the type of width product called for, we also decrease the product density, thereby allowing for superior penetration of chemical binders and stablizers of the type described in more detail below.

This lateral spreading in order to reduce unit weight and assure better chemical saturation and dispersion, is accomplished in a preferred embodiment of the invention by means of one or more bowed arches or members disposed in the path of the product. The product is caused to travel over and in contact with the bow(s) such that the center of the web-like product coincides with the highest part of the bow. Thus, by adding tension or stress to the product in a resultant downward direction, the product and its lateral extremities experience the least amount of resistance in lateral directions, with the result that a spreading or outward lateral spreading of product results.

While the terms "delivery" and "web product" may have been interchanged above, it is within the lateral spreading station that the product most nearly assumes a web-like shape. Other means for providing lateral product spreading according to the present invention include roll mechanisms, air bands and devices which will not be described here.

At this point in the specification it is important to again emphasize the fact that the present invention contemplates use of both natural and synthetic fibers and, in the case of synthetic fibers, we have fibers which occur or are available for sale in two basic forms—one being staple fibers which are basically fibers which are rather short in length, and the other being continuous filaments where (theoretically) one is able to deal with fibers with "infinite" length. In the case of the present invention, we are dealing with staple fibers. By "staple", in the case of cotton, as an example, a preferred length of cotton fibers is one to one and one-half inches. In the case of man-made fibers, such as polyester, polypropylene, etc., one is able to cut these synthetic fibers into predetermined lengths.

X. Temporary Wetting Station

Reference is now made to the temporary wetting station represented in FIG. 1 by the tenth block carrying this designation in the diagram, and wherein a preferred but optional procedure is accomplished. Depending upon the specific chemical binder being used, it may be advantageous to pre-wet the web product prior to applying a chemical binder in a manner which shall be described in more detail below. This pre-wetting facilitates the dispersion of the binder more uniformly throughout the web in those areas into which the application of binder is desired.

In other cases where dispersion is not desired, this entire step of pre-wetting is eliminated without affecting the scope and intent of the invention. In cases where an extremely ligh-weight web of cotton fiber is used, a temporary or prewetting of the web with water or water mixed with a desired wetting agent will increase fiber-to-fiber frictional properties that greatly enhance the ensuing binding application. The fluid or liquid utilized as a wetting agent in this step tends to destroy surface tension, thereby aiding the capillary action needed to draw the binder within the spaces between contiguous fibers.

XI. Discrete Binding Application Station

The next step in the process according to the present invention involves the discrete binding application station, represented by the next eleventh block in the diagram of FIG. 1, and wherein binding of the web product at specific or discrete locations takes place. While the example given here will involve the application of a chemical binder in the form of a resin, this invention contemplates the use of other substances and other means including, without limitation, the use of heat and ultrasonic equipment to accomplish the same purposes.

During the step of discrete binding, in a preferred embodiment of our invention, a series of relatively thin strips or areas of binder application (best illustrated in FIG. 3) are spaced from one another such that adjacent parallel fibers are joined at a plurality of spots along their respective lengths but, with unbound portions between these spot applications of the discrete binder. It is preferred to apply the binder or bind the fibers at least three points along the respective fiber lengths, although additional numbers of spots or lesser numbers (but at least two) will accomplish the desired results that will be described below.

The entire fiber lengths are not covered with the binder, but rather only specific desired and predetermined spots are covered by the resin. At a later step in this process, a second chemical application will involve a stabilizer compound wherein additional bonding will be accomplished.

The application of the discrete binder resin to the web is preferably done by either a printing or a spray application, each of which is wholly controllable. In the case of what is being referred to as "printing", the chemical binding resin is applied at specific discrete locations from the outer surfaces of a drum which comes into contact with the web in a rolling manner. This is done by means of grooves designed to carry the binding resin, with cooperative grooves on a roller directly opposite the points of contact along the web. A relatively fine width spray of the chemical resin will basically accomplish the same result. Again, it is important in this discrete binding application to avoid applying resin over the entire or even substantially the entire fiber lengths in order to facilitate the prestressing which will be described below.

Another feature of the present invention involves the use of a vacuum condition in a roller opposite the printing roll carrying grooves in which the chemical resin is placed for this discrete binding application. In other words, the web comes into contact with two rollers, the upper roller (or lower, if desired) carrying the resin binder at specific discrete locations, while the lower (or upper) roller has grooves in which a negative pressure is created by means of a vacuum pump or the like connected to a manifold. The use of an applying roll and a vacuum roll in this way greatly speeds up the penetration of the discrete binding resin such that the web is able to pass through the station at relatively higher speeds, yielding a more efficient process that results in a much more economical production of product than realized previously.

Yet another means by which the discrete binding is accomplished involves provision of a controlled electrostatic field in a specific and exact location adjacent the path of web such that a charge on the web results in an attraction of the binder to the points of charge, thereby joining the fibers at relatively fine positions or locations and greatly reducing the amount of binder being utilized in this step. It is contemplated that a spray application of the binder to these electrostatically charged fiber locations will accomplish this result.

XII. Binder Curing Station

Figure 3:
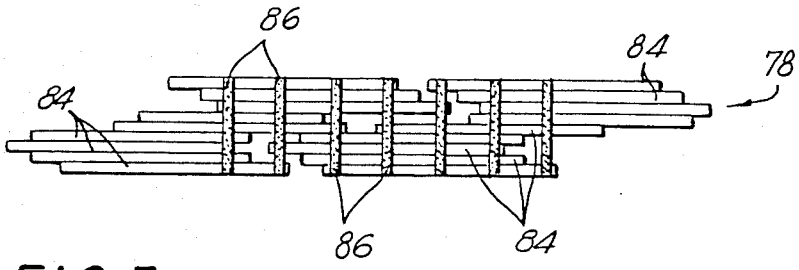
FIG. 3 is an enlarged fragmentary relatively top plan view illustrating a representation of oriented fibers which have been discretely bound together at predetermined points along their respective lengths, according to the present invention.

A principal purpose of discretely binding the fibers as illustrated in FIG. 3 is to hold the fibers substantially as shown so that a subsequent stressing of the fibers may be accomplished. Before this can be done, however, it is necessary to cure the resin binder that has been discretely applied and this is done as the next step and at the next station, represented by the next successive or sequential twelfth block in the diagram of FIG. 1 of the drawings. This curing of the binder preferably (but not necessarily) involves passing the discretely bound web through an area adjacent a source of heat which will fix the chemical resin being used as the binding agent. Other means of curing are, of course, contemplated without departing the spirit or scope of this invention.

Examples of binders used in the discrete binding application include acrylic latices which facilitate curing when the solvent medium in which they are suspended evaporates. For example, powdered polyethylene may be utilized as a binder placed in discrete locations, and the curing would be accomplished by proximity to an infrared or other heat source. It is the water-based solvents that are normally heat cured.

XIII. Stressing Station

Figure 2:
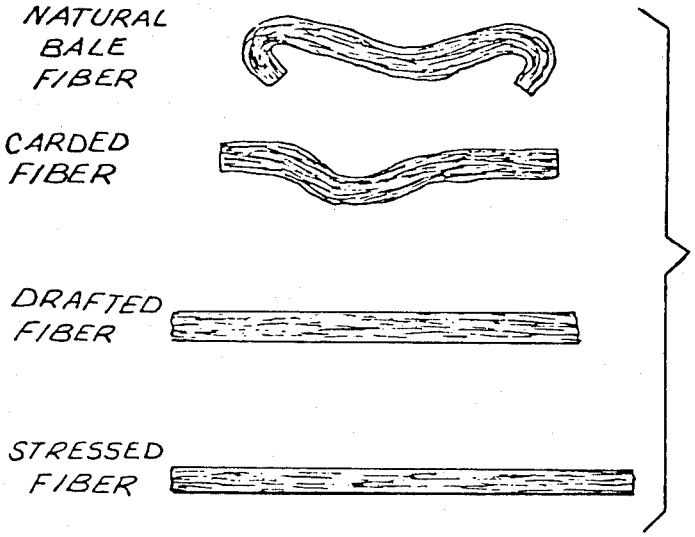
FIG. 2 is an enlarged fragmentary illustration of a representation of fiber in several of the states as it is processed according to the present invention.

At this point in this specification the reader is referred to FIG. 2 of the drawing wherein a specific natural bale fiber is shown in enlarged illustrative or schematic fashion. As labelled, the top illustration within FIG. 2 attempts to illustrate the condition of a natural bale fiber such as cotton, which has a natural crimp or irregularity. This same fiber will be slightly tensioned and slightly elongated during the carding operation within the carding engine and will generally assume the configuration shown in the second illustration of FIG. 2 adjacent "carded fiber".

This same fiber, after drafting by means of the methods already described above in terms of sliver lapping and within the drafting frame, results in a fiber configuration which is slightly tensioned and generally straight, as shown in the third illustration of FIG. 2 adjacent the term "drafted fiber", but in a condition able to be additionally elongated and stressed in tension. It is this last illustration within FIG. 2 adjacent the term "stressed fiber" that attempts to illustrate what is accomplished within the stressing station, represented by the next sequential thirteenth block within the diagram of FIG. 1, and wherein the drafted fiber or plurality of fibers which have been discretely bound and cured are stressed in tension by means of a plurality of pairs of rollers rotating at varying and predetermined speeds, which results in the additional elongation and tensioning of the fiber to a point where yet further addition of stress to the fiber will not result in any substantial further elongation, short of failure.

Thus, by means of successive varying peripheral speed rollers stressing the discretely bound web in tension and slightly elongating the previously drafted fiber, a specific and discrete amount of increase in length is realized without any deleterious or appreciable reduction in the diameter of the fibers as a result of this stressing. For convenience, we refer to this addition of stress to the web as a prestressing of the individual fibers within the assembly prior to yet further processing.

XIV. Stabilizer Application Station

Figure 4:
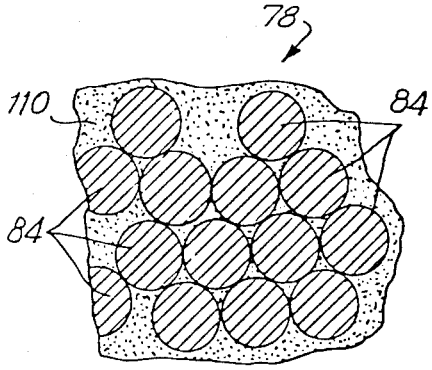
FIG. 4 is another relatively enlarged cross-sectional type illustration of a representation of oriented fibers after both discrete binding and stabilizing, according to the present invention.

Having prestressed or stressed the web that previously was discretely bound, the next step in this novel process involves the application of a stabilizing medium to the prestressed web at a stabilizer application station represented by the next block of the diagram in FIG. 1. Unlike the discrete binding application described above wherein only specific spots or portions of the fibers are contacted by a binding resin, at the stabilizer application station the prestressed condition of the web is captured by application of a stabilizer in the form of a resin or, by way of example only, any one of a series of the epoxide families, phenal formaldihydes, polysulfones, and others which are compatible with the fiber in the end product. FIG. 4 attempts to illustrate the encapsulated fibers which are contacted along their entire lengths (substantially) by the stabilizing compound.

The stabilizing compound chosen will be one compatible with the fiber such that, as in the case of certain epoxies wherein during curing they give off substantial quantities of heat and have the potential for destroying the properties of the fiber, compounds will be chosen which will avoid this undesirable condition. Another undesirable condition would result from use of a stabilizing compound with fibers which may be dissolved in whole or in part, and thus the specification of stabilizing compound will be dictated by the fiber content of the web product being produced and the environment in which the web product will ultimately be found when used according to its intended function.

Stabilizer Curing Station

The next step in the process according to the present invention involves curing of the stabilizer compound that was applied to the prestressed web in order to capture this prestressed condition at the stabilizer application station. This is done at a stabilizer curing station represented by the next fifteeth block of the diagram of FIG. 1. What has been stated for the curing of the discrete binder compound may equally apply here for the curing of the stabilizing compound and, therefore, a preferred example of curing involves passage of the prestressed web product with stabilizer compounds applied to it first over a vacuum extractor to remove excess binder and thereafter through an area adjacent an infrared or other suitable heat source.

It must be emphasized that the prestressed web is maintained in this stressed condition not only during the application of the stabilizer compound, but also during the curing process, in order to avoid any undesirable relaxation or unstressing of the web. The use of a vacuum extractor, while not absolutely necessary in order to accomplish the scope and spirit of the present invention, is desirable in those instances where removal of excess stabilizing compound is desirable, thereby increasing the fiber to stabilizer content ratio such that we have in essence coating or a saturation of the fiber web product. The fibers are substantially parallel and there is physical contact along their axes with predetermined amount of binder stabilizing compound on their surfaces.

One of the things we are avoiding with the present invention is production of a binder rich or resin rich material of the type currently marketed, such as in the case of some types of rigid fiber-reinforced composites. In the present invention the stabilizer content does not add materially as much to the strength of the composite as does the fiber in its prestressed state. The present invention is not dealing with reinforced plastic with fiber inserted, but rather with a specific web product that is in a prestressed condition wherein the prestressing is captured and held by means of stabilizing resin or other suitable equivalent compounds.

Thus, when ultimately used in the application for which designed, a substantially immediate resistance to applied stresses or applied forces makes the web according to the present invention far stronger than ever realized previously. This is so because we have stressed the fiber to its practical limit of stress elongation prior to the application of any outside force, and the instanteous resistance because the fiber has been prestressed in tension already results in little or no appreciable additional deflection or movement of the fiber in elongation before it exhibits its true tensile stress properties.

XVI. Web Take-off Station

The last step represented by the block labelled web take-off station in the diagram of FIG. 1 represents web handling apparatus which may be in the form of equipment which will roll up the web product after stabilizer curing or any of a number of different product handling means depending upon the flexibility and rigidity properties of the web product being produced.

Description With Reference Characters

Figure 5:
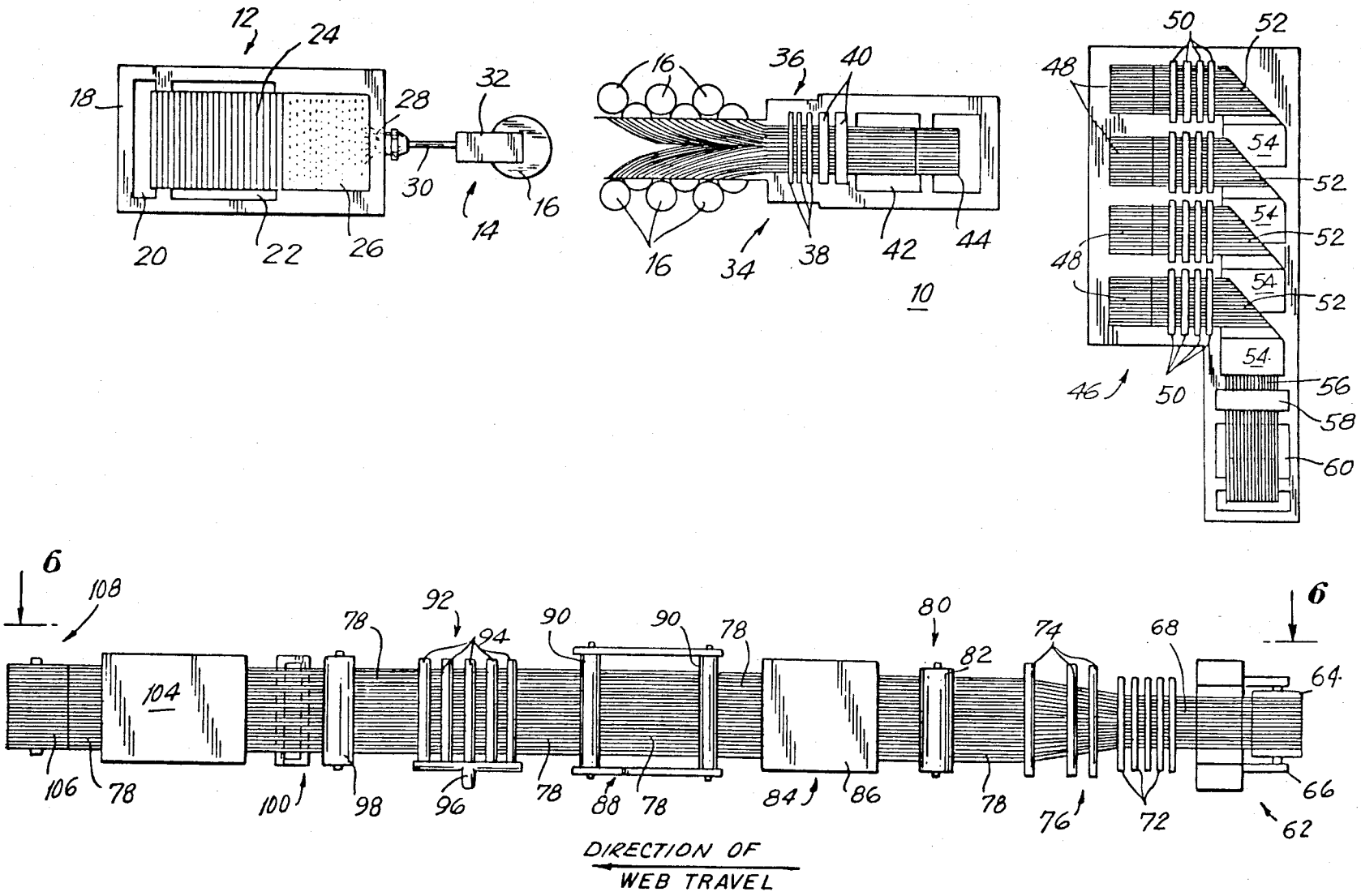
FIG. 5 is a top plan diagrammatic-type representation of an apparatus layout, coordinated at least in part with FIG. 1, for making product according to the present invention.
Figure 6:
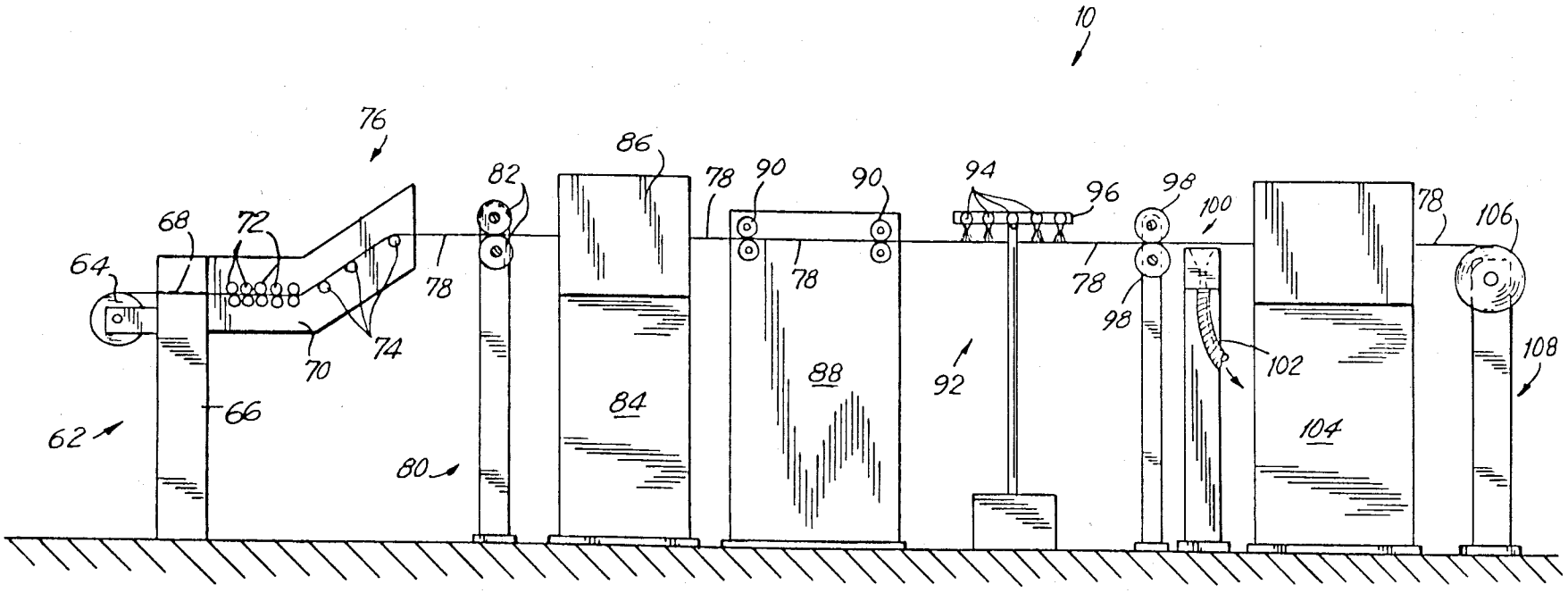
FIG. 6 is a side elevation diagrammatic-type representation of apparatus illustrated in FIG. 5.

At this point in this specification, specific reference characters shall be assigned to similar elements throughout the several views in order to give as much detail to the reader as possible. Reference is made to FIGS. 5 and 6, wherein top plan and side elevational views of apparatus that is used to practice the method of FIG. 1 is illustrated schematically. In this regard, this description commences with the carding engine of step four.

The system 10 of the present invention includes a carding engine 12 shown in cooperation with the sliver coiler 14, from which sliver is deposited in helical fashion into sliver cans 16. A feed plate 18 of carding engine 12 supports the fiber mass, chut feed, or picker lap being fed into the card. This product next encounters and engages a lickerin 20, which is a relatively small driven roller operating at high rotational speeds such that it is able to pluck the fibers from the lap and then transfer them to a larger master cylinder 22 of the card. Revolving flats 24 in the case of cotton fiber lapping are disposed atop large cylinder 22.

A doffer 26 in the form of another cylinder supporting radially extending carding wires next engages the fiber mass such that a relatively thin web 28 of fibers is delivered from the doffer 26 and is fed to a condensing unit 30 designated a "trumpet".

The next apparatus encountered by sliver exiting trumpet 30 is a coiler mechanism 32 which includes a rotating head capable of depositing sliver into sliver can 16. In a preferred embodiment, can 16 rotates upon a turntable (not shown).

The sheet material from the carding machine thus is condensed into the sliver that is received by the coiler cans. This sliver preferably contains 50 grains per linear yard of fiber. The fibrous sliver delivered by the carding engine is preferably drawn 8 to 1, and averages 80 slivers.

The next station 34 comprises the sliver lapping station described above, at which a number of ends of sliver are fed from a predetermined plurality of sliver cans 16 to a drafting unit 36 consisting of pairs of rollers (herein sometimes referred to as "rolls") 38. Rolls 38 are of the same or similar diameters.

Thus, in the case of some 20 slivers, each containing 50 grains per linear yard, the slivers are fed to the sliver lapping station. The resultant web discharged from the drafting frame station should contain 500 grains per lineal yard. Product discharged from the sliver lapping station includes fibers which have been drawn about 2 to 1 to make up a web weighing approximately 500 grains per running yard and then passing the material through. The drafting frame station at which the febrous web is ultimately drawn 8 to 1 moves to the lateral spreading station so that the station web will be lateral spread.

From rolls 38 the lap progresses to calendar rolls 40 before encountering a flat plate 42, and thereafter to yet another roll 44, from which the delivery is rolled up for later use.

At the ribbon lapping station 46 we see in FIG. 5 that four sliver lap rolls 48 are fed to a set of drafting rolls 50 before making a right-angle turn at book folds 52. These book folds serve the purpose of changing the direction of the drafted web material—here designated reference character 54. These webs 54 are fed in their new right-angle direction downwardly as shown in FIG. 5 such that they overlap one another, this overlapping having been made possible by the book folding.

The resulting lapped web 56 passes between a pair of calendar rolls 58 and is thereafter rolled up upon takeup roll 60, which is designed to carry a relatively heavy lap on the roll.

The speed of the rolls in the ribbon lapping station are adjustable, such that the drafting achieved is 4 to 1. Thus, if each of the webs contains the aforementioned 500 grains of cotton per lineal yard, the resulting lapped web will weigh approximately 125 grains per lineal yard.

Referring now to FIGS. 5 and 6 used in conjunction to illustrate the steps of FIG. 1 commencing with the drafting frame through the web take-off station, the drafting frame 62 is shown with a lap roll delivery 64 supported by frame 66 such that the heavy lap material 68 is delivered to a drafting head 70 including five pairs of rollers 72. In the drafting frame station the web is drafted 4 to 1, with the delivery containing 125 grains per lineal yard as compared to the initial 500 grains per lineal yard that entered. The web delivered by the drafting frame station must not be permitted to return to its previous state, with some degree of tension being maintained as it proceeds to the next station. Rollers 72 operate at sequentially different and increased peripheral speeds to provide a predetermined drawing or drafting desired. It is from roller pairs 72 that the product encounters and passes over a series or plurality of bowed arches 74 to accomplish the lateral spreading called for at lateral spreading station 76.

The fibrous web leaving the lateral spreading station contains approximately 800 grains of cotton fiber per square yard and which contains about 200 grains per square yard of binding agent has a tensile strength of approximately 50 pounds per inch in each direction when the separate webs are oriented with the major fiber direction of the fibrous webs at right angles to the major fiber direction of the other half of the webs and, when in each web about half of the fibers are held while tensioned in one direction. This is comparable to tensile strengths of approximately 25 pounds per inch in each direction for a cotton fabric based upon the same weight of fiber and binder which is constructed conventionally by weaving cotton yarn in which approximately equal amounts of fiber are present in both the machine direction and cross-machine direction. In the present system wherein substantially all or most of the staple fibers are oriented in the machine direction, far greater tensile strengths are achievable without sacrificing any of the remaining important web structural characteristics.

A web made according to this system is dense and compact, and for materials which contain about 200 grains of fiber per square yard, will exhibit compactness and fiber density that will permit the fabrication of webs with gauges as small as thousandths of an inch. Structural materials made up o fibrous webs produced according to the present system, either in the initial web form or, in the form of a hybrid composite formation containing a plurality of such webs, may be produced with ratios of gauge in thousandths of an inch relating to weights of fiber expressed in grains per square yard of approximately 1 to 200. Accordingly, it is possible to produce structural sheets of fibrous webs which exhibit tensile strengths in the machine direction in ranges of 15000–35,000 pounds per square inch. The fibers making up the web produced by the present system range from approximately 100 to about 325 grains per square yard in weight.

The web 78 leaving the lateral spreading station 76 next encounters the discrete binding application station 80 at which a pair of printing rolls 82 discretely deposit binder resin at predetermined spots along web 78. Throughout the steps of drafting, spreading, discrete binding, prestressing, and stabilizing, the apparatus causes the web to remain substantially planar, substantially permitting a pulling of the fibers laterally. In the present system, web speeds of 110 feet per minute are contemplated as between the drafting frame station and the stabilizing station. Web entering the discrete binding station has been drawn to the extent of approximately 40 to 1 prior to this point in the system.

For purposes of more clearly illustrating this within FIG. 3, a cut-away or fragmentary illustration of web 78 is shown to include a plurality of fibers 84 along which respective lengths of specific and discrete deposits 86 of binder resin hold spaced portions of these fibers 84 together prior to stressing.

The discretely bound web 78 thereafter leaves the discrete binding application station 80 and enters the discrete binder curing station 84 wherein an enclosed heat source 86 cures the discrete depositions on the web. Thereafter web 78 enters the stressing station 88, comprising a plurality of pairs of stressing rollers 90 in which successive peripheral speeds are controlled and vary such that the significant stressing of web 78 is accomplished. After leaving the stressing station 88, web 78 next encounters the stabilizer application station 92, at which a plurality of spray nozzles 94 connected to a delivery manifold 96 discharge a thorough coating of stabilizer resin onto the fibers making up web 78.

During this application of stabilizing compound at station 92, web 78 is maintained in its prestressed or stressed condition by means of tension holding rolls 98. After passing through these lateral rolls 98, excess stabilizing compound is removed by means of a vacuum extractor 100 connected by means of conduit 102 to a vacuum pump which does not comprise part of this invention. With the excess stabilizing compound removed, curing is accomplished within stabilizer curing station 104 in much the same manner as stated for curing station 84, whereupon web 78 in its prestressed and cured state is accumulated upon web take-off roll 106 at web take-off station 108.

The cured and stabilized fibers 84 are shown in FIG. 4 coated with stabilizing compound 110 in cross-sectional illustrative fashion.

The fibrous webs produced by the system of this invention can be used to create composite materials that possess the characteristics of high strength, low weight, and meaningful cost advantages fundamentally based upon the premise of eliminating conventional methods of making woven and other textile-like structures.

Thus, should a structure requiring compound curves, for example, be desired, either individual plies of the oriented and pre-stressed fibrous webs or laminations of either oriented or poly-axially oriented plies may be disposed in or against one or more predetermined surfaces (i.e., molds).

Bonding of these laminations may be accomplished, by way of example only, by the application of heat, pressure, or combinations thereof. In the case of pressure-bonding, it is contemplated that male and female die or mold surfaces will define the desired finished shapes.

The fabrication of composite exhibiting pre-stressed characteristics as a result of this system is accomplished without relieving or releasing the stress and forces captured within each fibrous web as a result of the stabilization step.

The present invention contemplates taking the web 78 delivered by this novel process and taking web product to a press, either at a later time or immediately upon creation of this prestressed and stabilized web. By applying tons of pressure to one or more layers of web product, a high strength pre-stressed rigid composite may be created in the shape of "board" or lumber to be used for any number of applications within the realm of this invention. Other uses of the web include the thickness and varying diameters, suitable for applications varying from mere conduit carrying of unpressured liquids to the high-pressure applications associated with oil rig work.

Great care has been taken in drafting the present specification to both disclose this invention in sufficient detail to pursue the patent protection desired to cover the article, the methods, and the apparatus for practicing the methods of this invention, without disclosing other aspects of the process which are desired to be kept in trade secret status. Specific details which are not necessary to disclose here will be maintained as trade secrets without prejudice to ensuing patent protection as provided by the law.

The embodiments of the invention clearly disclosed and described above are presently merely as examples of the invention. Other embodiments, forms and modifications of our invention coming within the proper scope and spirit of the appended claims will, of course, readily suggest themselves to those skilled in the art.

What is claimed is:

1. A method of forming a web of at least a plurality of fibers oriented in at least one predetermined direction, comprising steps which include: conveying a bale of fibers to a bale opening station, opening the bale, feeding the opened fibers to a carding engine, carding said fibers, coiling sliver of said fibers, lapping slivers, causing a plurality of fibers to be oriented in substantially parallel configuration with respect to one another, causing at least some of said oriented fibers to be interconnected with one another at a plurality of portions spaced longitudinally along their respective lengths, causing at least some of said interconnecting portions initially spaced a first distance from one another to be moved such that they are a second and greater distance from one another, and applying stabilizing resin to said interconnecting fiber portions and facilitating curing of said stabilizing resin prior to release of stress caused by said movement to the greater distance, thereby enhancing the ability of said web to withstand stresses applied thereto.

* * * * *